US007379035B2

(12) United States Patent
Suzuki et al.

(10) Patent No.: US 7,379,035 B2
(45) Date of Patent: May 27, 2008

(54) DISPLAY PANEL DRIVER DEVICE

(75) Inventors: Masahiro Suzuki, Yamanashi-ken (JP); Jun Kamiyamaguchi, Yamanashi-ken (JP); Tetsuya Shigeta, Yamanashi-ken (JP); Hirofumi Honda, Tokyo (JP); Tetsuro Nagakubo, Tokyo (JP)

(73) Assignee: Pioneer Corporation, Tokyo (JP)

( * ) Notice: Subject to any disclaimer, the term of this patent is extended or adjusted under 35 U.S.C. 154(b) by 714 days.

(21) Appl. No.: 10/882,149

(22) Filed: Jul. 1, 2004

(65) Prior Publication Data

US 2005/0057173 A1 Mar. 17, 2005

(30) Foreign Application Priority Data

Jul. 2, 2003 (JP) ..... 2003-190405

(51) Int. Cl.
*G09G 3/28* (2006.01)

(52) U.S. Cl. ..... 345/63; 345/36; 345/55; 345/76; 345/204

(58) Field of Classification Search ..... 345/63, 345/36, 55, 76, 204
See application file for complete search history.

(56) References Cited

U.S. PATENT DOCUMENTS

| | | | | |
|---|---|---|---|---|
| 6,297,788 | B1 | 10/2001 | Shigeta et al. | |
| 7,057,773 | B2 * | 6/2006 | Ilbery | 358/3.05 |
| 2002/0145619 | A1 * | 10/2002 | Hoppenbrouwers et al. | 345/690 |

FOREIGN PATENT DOCUMENTS

| | | |
|---|---|---|
| JP | 2000-227778 A | 8/2000 |
| KR | 2003-0006074 A | 1/2003 |

* cited by examiner

*Primary Examiner*—Richard Hjerpe
*Assistant Examiner*—Leonid Shapiro
(74) *Attorney, Agent, or Firm*—Sughrue Mion, PLLC

(57) ABSTRACT

A driver device for a display panel. Pixel cells are arranged on respective display lines of the display panel. Each N adjacent display lines makes one display line group. N is an integer of two or more. The pixels in each display line group are driven to emit light at different luminance levels based on one of M different dither patterns. One of the M dither patterns is selected sequentially and in predetermined periods, and the selected dither pattern is used. M is less than N. In the dither processing, N different weighting values are allocated to the N display lines in the display line group, respectively.

2 Claims, 14 Drawing Sheets

FIG. 2

[SELECTIVE ERASURE]

| Ds | HD 1 | 2 | 3 | 4 | 5 | 6 | 7 | 8 | 9 | 10 | 11 | 12 | 13 | 14 | LIGHT EMISSION DRIVE PATTERN IN ONE FIELD SF 1 | SF 2 | SF 3 | SF 4 | SF 5 | SF 6 | SF 7 | SF 8 | SF 9 | SF 10 | SF 11 | SF 12 | SF 13 | SF 14 | LIGHT EMISSION LUMINANCE |
|---|---|---|---|---|---|---|---|---|---|---|---|---|---|---|---|---|---|---|---|---|---|---|---|---|---|---|---|---|---|
| 0000 | 1 | 0 | 0 | 0 | 0 | 0 | 0 | 0 | 0 | 0 | 0 | 0 | 0 | 0 | ● | | | | | | | | | | | | | | 0 |
| 0001 | 0 | 1 | 0 | 0 | 0 | 0 | 0 | 0 | 0 | 0 | 0 | 0 | 0 | 0 | ○ | ● | | | | | | | | | | | | | 1 |
| 0010 | 0 | 0 | 1 | 0 | 0 | 0 | 0 | 0 | 0 | 0 | 0 | 0 | 0 | 0 | ○ | ○ | ● | | | | | | | | | | | | 4 |
| 0011 | 0 | 0 | 0 | 1 | 0 | 0 | 0 | 0 | 0 | 0 | 0 | 0 | 0 | 0 | ○ | ○ | ○ | ● | | | | | | | | | | | 9 |
| 0100 | 0 | 0 | 0 | 0 | 1 | 0 | 0 | 0 | 0 | 0 | 0 | 0 | 0 | 0 | ○ | ○ | ○ | ○ | ● | | | | | | | | | | 17 |
| 0101 | 0 | 0 | 0 | 0 | 0 | 1 | 0 | 0 | 0 | 0 | 0 | 0 | 0 | 0 | ○ | ○ | ○ | ○ | ○ | ● | | | | | | | | | 27 |
| 0110 | 0 | 0 | 0 | 0 | 0 | 0 | 1 | 0 | 0 | 0 | 0 | 0 | 0 | 0 | ○ | ○ | ○ | ○ | ○ | ○ | ● | | | | | | | | 40 |
| 0111 | 0 | 0 | 0 | 0 | 0 | 0 | 0 | 1 | 0 | 0 | 0 | 0 | 0 | 0 | ○ | ○ | ○ | ○ | ○ | ○ | ○ | ● | | | | | | | 56 |
| 1000 | 0 | 0 | 0 | 0 | 0 | 0 | 0 | 0 | 1 | 0 | 0 | 0 | 0 | 0 | ○ | ○ | ○ | ○ | ○ | ○ | ○ | ○ | ● | | | | | | 75 |
| 1001 | 0 | 0 | 0 | 0 | 0 | 0 | 0 | 0 | 0 | 1 | 0 | 0 | 0 | 0 | ○ | ○ | ○ | ○ | ○ | ○ | ○ | ○ | ○ | ● | | | | | 97 |
| 1010 | 0 | 0 | 0 | 0 | 0 | 0 | 0 | 0 | 0 | 0 | 1 | 0 | 0 | 0 | ○ | ○ | ○ | ○ | ○ | ○ | ○ | ○ | ○ | ○ | ● | | | | 122 |
| 1011 | 0 | 0 | 0 | 0 | 0 | 0 | 0 | 0 | 0 | 0 | 0 | 1 | 0 | 0 | ○ | ○ | ○ | ○ | ○ | ○ | ○ | ○ | ○ | ○ | ○ | ● | | | 150 |
| 1100 | 0 | 0 | 0 | 0 | 0 | 0 | 0 | 0 | 0 | 0 | 0 | 0 | 1 | 0 | ○ | ○ | ○ | ○ | ○ | ○ | ○ | ○ | ○ | ○ | ○ | ○ | ● | | 182 |
| 1101 | 0 | 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ○ | ● | 217 |
| 1110 | 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | 256 |

BLACK CIRCLE: SELECTIVE ERASURE DISCHARGE
WHITE CIRCLE: LIGHT EMISSION

FIG. 6

| CONVERSION TABLE | |
|---|---|
| MD | GD<br>0 1 2 3 |
| 000 | 1 0 0 0 |
| 001 | 0 1 0 0 |
| 010 | 0 0 1 0 |
| 011 | 0 0 0 1 |
| 100 | 0 0 0 0 |

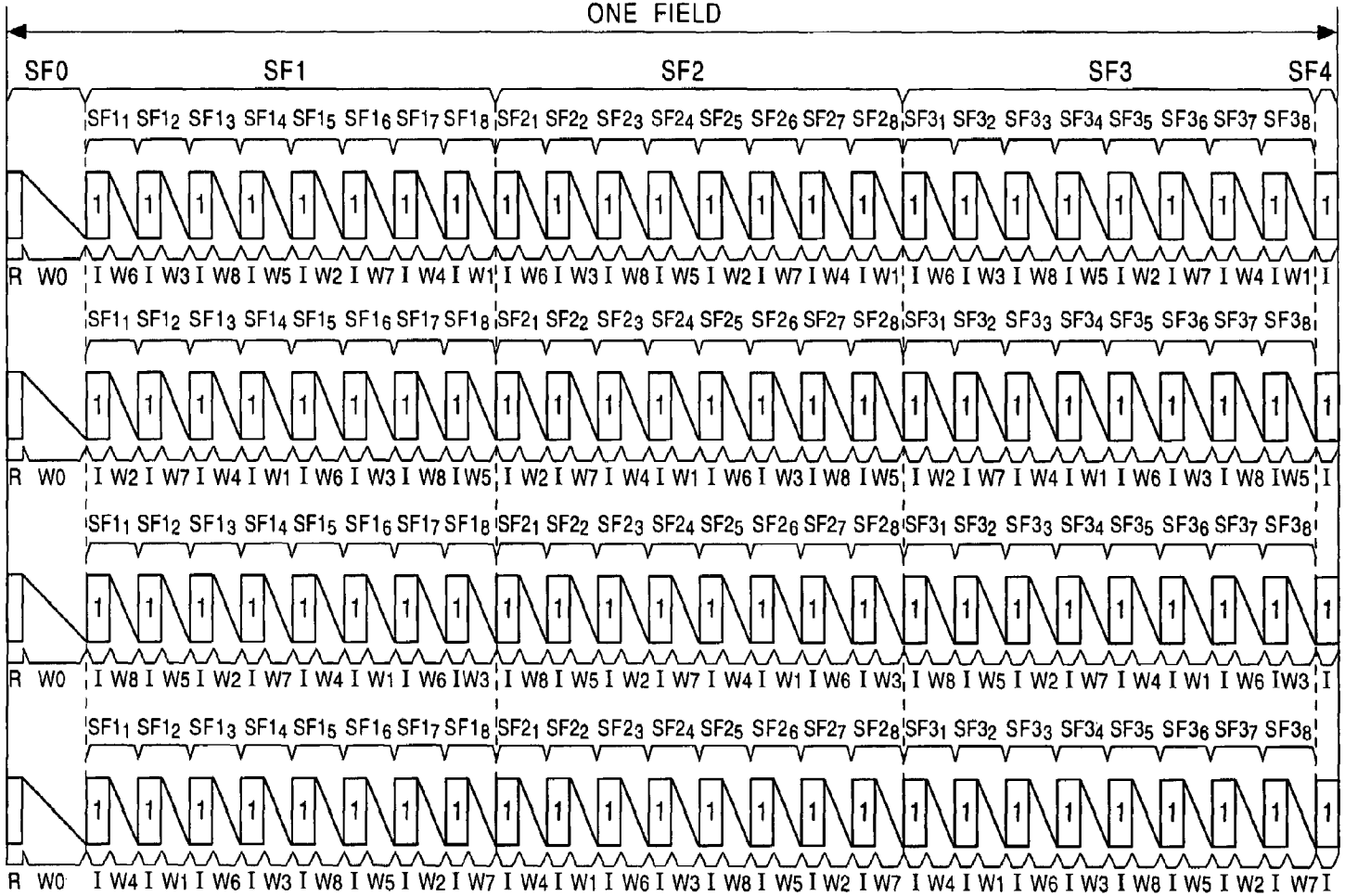
FIG. 7A FIRST FIELD ⇒ FIG. 7B SECOND FIELD ⇒ FIG. 7C THIRD FIELD ⇒ FIG. 7D FOURTH FIELD

FIG. 8

| | PIXEL DRIVE DATA GD 0 1 2 3 | DISPLAY LINE | LIGHT EMISSION PATTERN SF 0 | SF $1_1$ | SF $1_2$ | SF $1_3$ | SF $1_4$ | SF $1_5$ | SF $1_6$ | SF $1_7$ | SF $1_8$ | SF $2_1$ | SF $2_2$ | SF $2_3$ | SF $2_4$ | SF $2_5$ | SF $2_6$ | SF $2_7$ | SF $2_8$ | SF $3_1$ | SF $3_2$ | SF $3_3$ | SF $3_4$ | SF $3_5$ | SF $3_6$ | SF $3_7$ | SF $3_8$ | SF 4 | LUMI-NANCE |
|---|---|---|---|---|---|---|---|---|---|---|---|---|---|---|---|---|---|---|---|---|---|---|---|---|---|---|---|---|---|
| FIRST GRAYSCALE DRIVING | 1 0 0 0 | 8N-7 | ● | | | | | | | | | | | | | | | | | | | | | | | | | | 0 |
| | | 8N-6 | ● | | | | | | | | | | | | | | | | | | | | | | | | | | 0 |
| | | 8N-5 | ● | | | | | | | | | | | | | | | | | | | | | | | | | | 0 |
| | | 8N-4 | ● | | | | | | | | | | | | | | | | | | | | | | | | | | 0 |
| | | 8N-3 | ● | | | | | | | | | | | | | | | | | | | | | | | | | | 0 |
| | | 8N-2 | ● | | | | | | | | | | | | | | | | | | | | | | | | | | 0 |
| | | 8N-1 | ● | | | | | | | | | | | | | | | | | | | | | | | | | | 0 |
| | | 8N | ● | | | | | | | | | | | | | | | | | | | | | | | | | | 0 |
| SECOND GRAYSCALE DRIVING | 0 1 0 0 | 8N-7 | | ○ | ○ | ○ | ○ | ○ | ○ | ○ | ◉ | | | | | | | | | | | | | | | | | | 8 |
| | | 8N-6 | | ○ | ○ | ○ | ○ | ◉ | | | | | | | | | | | | | | | | | | | | | 5 |
| | | 8N-5 | | ○ | ◉ | | | | | | | | | | | | | | | | | | | | | | | | 2 |
| | | 8N-4 | | ○ | ○ | ○ | ○ | ○ | ○ | ◉ | | | | | | | | | | | | | | | | | | | 7 |
| | | 8N-3 | | ○ | ○ | ○ | ◉ | | | | | | | | | | | | | | | | | | | | | | 4 |
| | | 8N-2 | | ◉ | | | | | | | | | | | | | | | | | | | | | | | | | 1 |
| | | 8N-1 | | ○ | ○ | ○ | ○ | ○ | ◉ | | | | | | | | | | | | | | | | | | | | 6 |
| | | 8N | | ○ | ○ | ◉ | | | | | | | | | | | | | | | | | | | | | | | 3 |
| THIRD GRAYSCALE DRIVING | 0 0 1 0 | 8N-7 | | ○ | ○ | ○ | ○ | ○ | ○ | ○ | ○ | ○ | ○ | ○ | ○ | ○ | ○ | ○ | ◉ | | | | | | | | | | 16 |
| | | 8N-6 | | ○ | ○ | ○ | ○ | ○ | ○ | ○ | ○ | ○ | ○ | ○ | ○ | ◉ | | | | | | | | | | | | | 13 |
| | | 8N-5 | | ○ | ○ | ○ | ○ | ○ | ○ | ○ | ○ | ○ | ◉ | | | | | | | | | | | | | | | | 10 |
| | | 8N-4 | | ○ | ○ | ○ | ○ | ○ | ○ | ○ | ○ | ○ | ○ | ○ | ○ | ○ | ○ | ◉ | | | | | | | | | | | 15 |
| | | 8N-3 | | ○ | ○ | ○ | ○ | ○ | ○ | ○ | ○ | ○ | ○ | ○ | ◉ | | | | | | | | | | | | | | 12 |
| | | 8N-2 | | ○ | ○ | ○ | ○ | ○ | ○ | ○ | ○ | ◉ | | | | | | | | | | | | | | | | | 9 |
| | | 8N-1 | | ○ | ○ | ○ | ○ | ○ | ○ | ○ | ○ | ○ | ○ | ○ | ○ | ○ | ◉ | | | | | | | | | | | | 14 |
| | | 8N | | ○ | ○ | ○ | ○ | ○ | ○ | ○ | ○ | ○ | ○ | ◉ | | | | | | | | | | | | | | | 11 |
| FOURTH GRAYSCALE DRIVING | 0 0 0 1 | 8N-7 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ◉ | | 24 |
| | | 8N-6 | | ○ | ○ | ○ | ○ | ○ | ○ | ○ | ○ | ○ | ○ | ○ | ○ | ○ | ○ | ○ | ○ | ○ | ○ | ○ | ○ | ◉ | | | | | 21 |
| | | 8N-5 | | ○ | ○ | ○ | ○ | ○ | ○ | ○ | ○ | ○ | ○ | ○ | ○ | ○ | ○ | ○ | ○ | ○ | ◉ | | | | | | | | 18 |
| | | 8N-4 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ◉ | | | 23 |
| | | 8N-3 | | ○ | ○ | ○ | ○ | ○ | ○ | ○ | ○ | ○ | ○ | ○ | ○ | ○ | ○ | ○ | ○ | ○ | ○ | ○ | ◉ | | | | | | 20 |
| | | 8N-2 | | ○ | ○ | ○ | ○ | ○ | ○ | ○ | ○ | ○ | ○ | ○ | ○ | ○ | ○ | ○ | ○ | ◉ | | | | | | | | | 17 |
| | | 8N-1 | | ○ | ○ | ○ | ○ | ○ | ○ | ○ | ○ | ○ | ○ | ○ | ○ | ○ | ○ | ○ | ○ | ○ | ○ | ○ | ○ | ○ | ◉ | | | | 22 |
| | | 8N | | ○ | ○ | ○ | ○ | ○ | ○ | ○ | ○ | ○ | ○ | ○ | ○ | ○ | ○ | ○ | ○ | ○ | ○ | ◉ | | | | | | | 19 |
| FIFTH GRAYSCALE DRIVING | 0 0 0 0 | 8N-7 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | | 8N-6 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | | 8N-5 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | | 8N-4 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | | 8N-3 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | | 8N-2 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | | 8N-1 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | | 8N | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |

FIG. 9

| PIXEL DRIVE DATA GD 0 1 2 3 | DISPLAY LINE | LIGHT EMISSION PATTERN SF 0 | SF $1_1$ | SF $1_2$ | SF $1_3$ | SF $1_4$ | SF $1_5$ | SF $1_6$ | SF $1_7$ | SF $1_8$ | SF $2_1$ | SF $2_2$ | SF $2_3$ | SF $2_4$ | SF $2_5$ | SF $2_6$ | SF $2_7$ | SF $2_8$ | SF $3_1$ | SF $3_2$ | SF $3_3$ | SF $3_4$ | SF $3_5$ | SF $3_6$ | SF $3_7$ | SF $3_8$ | SF 4 | LUMI-NANCE |
|---|---|---|---|---|---|---|---|---|---|---|---|---|---|---|---|---|---|---|---|---|---|---|---|---|---|---|---|---|
| 1 0 0 0 | 8N-7 | ● | | | | | | | | | | | | | | | | | | | | | | | | | | 0 |
| | 8N-6 | ● | | | | | | | | | | | | | | | | | | | | | | | | | | 0 |
| | 8N-5 | ● | | | | | | | | | | | | | | | | | | | | | | | | | | 0 |
| | 8N-4 | ● | | | | | | | | | | | | | | | | | | | | | | | | | | 0 |
| | 8N-3 | ● | | | | | | | | | | | | | | | | | | | | | | | | | | 0 |
| | 8N-2 | ● | | | | | | | | | | | | | | | | | | | | | | | | | | 0 |
| | 8N-1 | ● | | | | | | | | | | | | | | | | | | | | | | | | | | 0 |
| | 8N | ● | | | | | | | | | | | | | | | | | | | | | | | | | | 0 |
| 0 1 0 0 | 8N-7 | | ○ | ○ | ○ | ◉ | | | | | | | | | | | | | | | | | | | | | | 4 |
| | 8N-6 | | ◉ | | | | | | | | | | | | | | | | | | | | | | | | | 1 |
| | 8N-5 | | ○ | ○ | ○ | ○ | ○ | ◉ | | | | | | | | | | | | | | | | | | | | 6 |
| | 8N-4 | | ○ | ○ | ◉ | | | | | | | | | | | | | | | | | | | | | | | 3 |
| | 8N-3 | | ○ | ○ | ○ | ○ | ○ | ○ | ○ | ◉ | | | | | | | | | | | | | | | | | | 8 |
| | 8N-2 | | ○ | ○ | ○ | ○ | ◉ | | | | | | | | | | | | | | | | | | | | | 5 |
| | 8N-1 | | ○ | ◉ | | | | | | | | | | | | | | | | | | | | | | | | 2 |
| | 8N | | ○ | ○ | ○ | ○ | ○ | ○ | ◉ | | | | | | | | | | | | | | | | | | | 7 |
| 0 0 1 0 | 8N-7 | | ○ | ○ | ○ | ○ | ○ | ○ | ○ | ○ | ○ | ○ | ○ | ◉ | | | | | | | | | | | | | | 12 |
| | 8N-6 | | ○ | ○ | ○ | ○ | ○ | ○ | ○ | ○ | ◉ | | | | | | | | | | | | | | | | | 9 |
| | 8N-5 | | ○ | ○ | ○ | ○ | ○ | ○ | ○ | ○ | ○ | ○ | ○ | ○ | ○ | ◉ | | | | | | | | | | | | 14 |
| | 8N-4 | | ○ | ○ | ○ | ○ | ○ | ○ | ○ | ○ | ○ | ○ | ◉ | | | | | | | | | | | | | | | 11 |
| | 8N-3 | | ○ | ○ | ○ | ○ | ○ | ○ | ○ | ○ | ○ | ○ | ○ | ○ | ○ | ○ | ○ | ◉ | | | | | | | | | | 16 |
| | 8N-2 | | ○ | ○ | ○ | ○ | ○ | ○ | ○ | ○ | ○ | ○ | ○ | ○ | ◉ | | | | | | | | | | | | | 13 |
| | 8N-1 | | ○ | ○ | ○ | ○ | ○ | ○ | ○ | ○ | ○ | ◉ | | | | | | | | | | | | | | | | 10 |
| | 8N | | ○ | ○ | ○ | ○ | ○ | ○ | ○ | ○ | ○ | ○ | ○ | ○ | ○ | ○ | ◉ | | | | | | | | | | | 15 |
| 0 0 0 1 | 8N-7 | | ○ | ○ | ○ | ○ | ○ | ○ | ○ | ○ | ○ | ○ | ○ | ○ | ○ | ○ | ○ | ○ | ○ | ○ | ○ | ◉ | | | | | | 20 |
| | 8N-6 | | ○ | ○ | ○ | ○ | ○ | ○ | ○ | ○ | ○ | ○ | ○ | ○ | ○ | ○ | ○ | ○ | ◉ | | | | | | | | | 17 |
| | 8N-5 | | ○ | ○ | ○ | ○ | ○ | ○ | ○ | ○ | ○ | ○ | ○ | ○ | ○ | ○ | ○ | ○ | ○ | ○ | ○ | ○ | ○ | ◉ | | | | 22 |
| | 8N-4 | | ○ | ○ | ○ | ○ | ○ | ○ | ○ | ○ | ○ | ○ | ○ | ○ | ○ | ○ | ○ | ○ | ○ | ○ | ◉ | | | | | | | 19 |
| | 8N-3 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ◉ | | 24 |
| | 8N-2 | | ○ | ○ | ○ | ○ | ○ | ○ | ○ | ○ | ○ | ○ | ○ | ○ | ○ | ○ | ○ | ○ | ○ | ○ | ○ | ○ | ◉ | | | | | 21 |
| | 8N-1 | | ○ | ○ | ○ | ○ | ○ | ○ | ○ | ○ | ○ | ○ | ○ | ○ | ○ | ○ | ○ | ○ | ○ | ◉ | | | | | | | | 18 |
| | 8N | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ◉ | | | 23 |
| 0 0 0 0 | 8N-7 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-6 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-5 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-4 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-3 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-2 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-1 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |

FIG. 10

| PIXEL DRIVE DATA GD 0 1 2 3 | DISPLAY LINE | LIGHT EMISSION PATTERN SF 0 | SF $1_1$ | SF $1_2$ | SF $1_3$ | SF $1_4$ | SF $1_5$ | SF $1_6$ | SF $1_7$ | SF $1_8$ | SF $2_1$ | SF $2_2$ | SF $2_3$ | SF $2_4$ | SF $2_5$ | SF $2_6$ | SF $2_7$ | SF $2_8$ | SF $3_1$ | SF $3_2$ | SF $3_3$ | SF $3_4$ | SF $3_5$ | SF $3_6$ | SF $3_7$ | SF $3_8$ | SF 4 | LUMINANCE |
|---|---|---|---|---|---|---|---|---|---|---|---|---|---|---|---|---|---|---|---|---|---|---|---|---|---|---|---|---|
| 1 0 0 0 | 8N-7 | ● | | | | | | | | | | | | | | | | | | | | | | | | | | 0 |
| | 8N-6 | ● | | | | | | | | | | | | | | | | | | | | | | | | | | 0 |
| | 8N-5 | ● | | | | | | | | | | | | | | | | | | | | | | | | | | 0 |
| | 8N-4 | ● | | | | | | | | | | | | | | | | | | | | | | | | | | 0 |
| | 8N-3 | ● | | | | | | | | | | | | | | | | | | | | | | | | | | 0 |
| | 8N-2 | ● | | | | | | | | | | | | | | | | | | | | | | | | | | 0 |
| | 8N-1 | ● | | | | | | | | | | | | | | | | | | | | | | | | | | 0 |
| | 8N | ● | | | | | | | | | | | | | | | | | | | | | | | | | | 0 |
| 0 1 0 0 | 8N-7 | | ○ | ○ | ○ | ○ | ○ | ◉ | | | | | | | | | | | | | | | | | | | | 6 |
| | 8N-6 | | ○ | ○ | ◉ | | | | | | | | | | | | | | | | | | | | | | | 3 |
| | 8N-5 | | ○ | ○ | ○ | ○ | ○ | ○ | ○ | ◉ | | | | | | | | | | | | | | | | | | 8 |
| | 8N-4 | | ○ | ○ | ○ | ○ | ◉ | | | | | | | | | | | | | | | | | | | | | 5 |
| | 8N-3 | | ○ | ◉ | | | | | | | | | | | | | | | | | | | | | | | | 2 |
| | 8N-2 | | ○ | ○ | ○ | ○ | ○ | ○ | ◉ | | | | | | | | | | | | | | | | | | | 7 |
| | 8N-1 | | ○ | ○ | ○ | ◉ | | | | | | | | | | | | | | | | | | | | | | 4 |
| | 8N | | ◉ | | | | | | | | | | | | | | | | | | | | | | | | | 1 |
| 0 0 1 0 | 8N-7 | | ○ | ○ | ○ | ○ | ○ | ○ | ○ | ○ | ○ | ○ | ○ | ○ | ○ | ◉ | | | | | | | | | | | | 14 |
| | 8N-6 | | ○ | ○ | ○ | ○ | ○ | ○ | ○ | ○ | ○ | ○ | ◉ | | | | | | | | | | | | | | | 11 |
| | 8N-5 | | ○ | ○ | ○ | ○ | ○ | ○ | ○ | ○ | ○ | ○ | ○ | ○ | ○ | ○ | ○ | ◉ | | | | | | | | | | 16 |
| | 8N-4 | | ○ | ○ | ○ | ○ | ○ | ○ | ○ | ○ | ○ | ○ | ○ | ○ | ◉ | | | | | | | | | | | | | 13 |
| | 8N-3 | | ○ | ○ | ○ | ○ | ○ | ○ | ○ | ○ | ○ | ◉ | | | | | | | | | | | | | | | | 10 |
| | 8N-2 | | ○ | ○ | ○ | ○ | ○ | ○ | ○ | ○ | ○ | ○ | ○ | ○ | ○ | ○ | ◉ | | | | | | | | | | | 15 |
| | 8N-1 | | ○ | ○ | ○ | ○ | ○ | ○ | ○ | ○ | ○ | ○ | ○ | ◉ | | | | | | | | | | | | | | 12 |
| | 8N | | ○ | ○ | ○ | ○ | ○ | ○ | ○ | ○ | ◉ | | | | | | | | | | | | | | | | | 9 |
| 0 0 0 1 | 8N-7 | | ○ | ○ | ○ | ○ | ○ | ○ | ○ | ○ | ○ | ○ | ○ | ○ | ○ | ○ | ○ | ○ | ○ | ○ | ○ | ○ | ○ | ◉ | | | | 22 |
| | 8N-6 | | ○ | ○ | ○ | ○ | ○ | ○ | ○ | ○ | ○ | ○ | ○ | ○ | ○ | ○ | ○ | ○ | ○ | ○ | ◉ | | | | | | | 19 |
| | 8N-5 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ◉ | | 24 |
| | 8N-4 | | ○ | ○ | ○ | ○ | ○ | ○ | ○ | ○ | ○ | ○ | ○ | ○ | ○ | ○ | ○ | ○ | ○ | ○ | ○ | ○ | ◉ | | | | | 21 |
| | 8N-3 | | ○ | ○ | ○ | ○ | ○ | ○ | ○ | ○ | ○ | ○ | ○ | ○ | ○ | ○ | ○ | ○ | ○ | ◉ | | | | | | | | 18 |
| | 8N-2 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ◉ | | | 23 |
| | 8N-1 | | ○ | ○ | ○ | ○ | ○ | ○ | ○ | ○ | ○ | ○ | ○ | ○ | ○ | ○ | ○ | ○ | ○ | ○ | ○ | ◉ | | | | | | 20 |
| | 8N | | ○ | ○ | ○ | ○ | ○ | ○ | ○ | ○ | ○ | ○ | ○ | ○ | ○ | ○ | ○ | ○ | ◉ | | | | | | | | | 17 |
| 0 0 0 0 | 8N-7 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-6 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-5 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-4 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-3 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-2 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-1 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |

FIG. 11

| PIXEL DRIVE DATA GD 0 1 2 3 | DISPLAY LINE | LIGHT EMISSION PATTERN SF 0 | SF $1_1$ | SF $1_2$ | SF $1_3$ | SF $1_4$ | SF $1_5$ | SF $1_6$ | SF $1_7$ | SF $1_8$ | SF $2_1$ | SF $2_2$ | SF $2_3$ | SF $2_4$ | SF $2_5$ | SF $2_6$ | SF $2_7$ | SF $2_8$ | SF $3_1$ | SF $3_2$ | SF $3_3$ | SF $3_4$ | SF $3_5$ | SF $3_6$ | SF $3_7$ | SF $3_8$ | SF 4 | LUMINANCE |
|---|---|---|---|---|---|---|---|---|---|---|---|---|---|---|---|---|---|---|---|---|---|---|---|---|---|---|---|---|
| 1 0 0 0 | 8N-7 | ● | | | | | | | | | | | | | | | | | | | | | | | | | | 0 |
| | 8N-6 | ● | | | | | | | | | | | | | | | | | | | | | | | | | | 0 |
| | 8N-5 | ● | | | | | | | | | | | | | | | | | | | | | | | | | | 0 |
| | 8N-4 | ● | | | | | | | | | | | | | | | | | | | | | | | | | | 0 |
| | 8N-3 | ● | | | | | | | | | | | | | | | | | | | | | | | | | | 0 |
| | 8N-2 | ● | | | | | | | | | | | | | | | | | | | | | | | | | | 0 |
| | 8N-1 | ● | | | | | | | | | | | | | | | | | | | | | | | | | | 0 |
| | 8N | ● | | | | | | | | | | | | | | | | | | | | | | | | | | 0 |
| 0 1 0 0 | 8N-7 | | ○ | ◉ | | | | | | | | | | | | | | | | | | | | | | | | 2 |
| | 8N-6 | | ○ | ○ | ○ | ○ | ○ | ○ | ◉ | | | | | | | | | | | | | | | | | | | 7 |
| | 8N-5 | | ○ | ○ | ○ | ◉ | | | | | | | | | | | | | | | | | | | | | | 4 |
| | 8N-4 | | ◉ | | | | | | | | | | | | | | | | | | | | | | | | | 1 |
| | 8N-3 | | ○ | ○ | ○ | ○ | ○ | ◉ | | | | | | | | | | | | | | | | | | | | 6 |
| | 8N-2 | | ○ | ○ | ◉ | | | | | | | | | | | | | | | | | | | | | | | 3 |
| | 8N-1 | | ○ | ○ | ○ | ○ | ○ | ○ | ○ | ◉ | | | | | | | | | | | | | | | | | | 8 |
| | 8N | | ○ | ○ | ○ | ○ | ◉ | | | | | | | | | | | | | | | | | | | | | 5 |
| 0 0 1 0 | 8N-7 | | ○ | ○ | ○ | ○ | ○ | ○ | ○ | ○ | ○ | ◉ | | | | | | | | | | | | | | | | 10 |
| | 8N-6 | | ○ | ○ | ○ | ○ | ○ | ○ | ○ | ○ | ○ | ○ | ○ | ○ | ○ | ○ | ◉ | | | | | | | | | | | 15 |
| | 8N-5 | | ○ | ○ | ○ | ○ | ○ | ○ | ○ | ○ | ○ | ○ | ○ | ◉ | | | | | | | | | | | | | | 12 |
| | 8N-4 | | ○ | ○ | ○ | ○ | ○ | ○ | ○ | ○ | ◉ | | | | | | | | | | | | | | | | | 9 |
| | 8N-3 | | ○ | ○ | ○ | ○ | ○ | ○ | ○ | ○ | ○ | ○ | ○ | ○ | ○ | ◉ | | | | | | | | | | | | 14 |
| | 8N-2 | | ○ | ○ | ○ | ○ | ○ | ○ | ○ | ○ | ○ | ○ | ◉ | | | | | | | | | | | | | | | 11 |
| | 8N-1 | | ○ | ○ | ○ | ○ | ○ | ○ | ○ | ○ | ○ | ○ | ○ | ○ | ○ | ○ | ○ | ◉ | | | | | | | | | | 16 |
| | 8N | | ○ | ○ | ○ | ○ | ○ | ○ | ○ | ○ | ○ | ○ | ○ | ○ | ◉ | | | | | | | | | | | | | 13 |
| 0 0 0 1 | 8N-7 | | ○ | ○ | ○ | ○ | ○ | ○ | ○ | ○ | ○ | ○ | ○ | ○ | ○ | ○ | ○ | ○ | ○ | ◉ | | | | | | | | 18 |
| | 8N-6 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ◉ | | | 23 |
| | 8N-5 | | ○ | ○ | ○ | ○ | ○ | ○ | ○ | ○ | ○ | ○ | ○ | ○ | ○ | ○ | ○ | ○ | ○ | ○ | ○ | ◉ | | | | | | 20 |
| | 8N-4 | | ○ | ○ | ○ | ○ | ○ | ○ | ○ | ○ | ○ | ○ | ○ | ○ | ○ | ○ | ○ | ○ | ◉ | | | | | | | | | 17 |
| | 8N-3 | | ○ | ○ | ○ | ○ | ○ | ○ | ○ | ○ | ○ | ○ | ○ | ○ | ○ | ○ | ○ | ○ | ○ | ○ | ○ | ○ | ○ | ◉ | | | | 22 |
| | 8N-2 | | ○ | ○ | ○ | ○ | ○ | ○ | ○ | ○ | ○ | ○ | ○ | ○ | ○ | ○ | ○ | ○ | ○ | ○ | ◉ | | | | | | | 19 |
| | 8N-1 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ◉ | | 24 |
| | 8N | | ○ | ○ | ○ | ○ | ○ | ○ | ○ | ○ | ○ | ○ | ○ | ○ | ○ | ○ | ○ | ○ | ○ | ○ | ○ | ○ | ◉ | | | | | 21 |
| 0 0 0 0 | 8N-7 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-6 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-5 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-4 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-3 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-2 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N-1 | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |
| | 8N | | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | ○ | 25 |

DISPLAY PANEL DRIVER DEVICE

BACKGROUND OF THE INVENTION

Field of the Invention

The present invention relates to a driver device for a display panel which has pixel cells, serving as pixels, arranged on respective display lines of the display panel.

Recently, where two-dimensional image display panels are concerned, plasma display panels (hereinafter called 'PDP'), in which a plurality of discharge cells are arranged in the form of a matrix, have been attracting attention. The subfield method is known as a driving method for displaying an image corresponding with a video input signal on the PDP. The subfield method divides a single-field display period into a plurality of subfields and causes each of the discharge cells to selectively discharge light in each subfield in accordance with the luminance level represented by the video input signal. Accordingly, an intermediate or grayscale luminance corresponding with the total light emission period within the single-field period is then perceived.

FIG. 1 of the attached drawings shows an example of a light emission drive sequence based on this subfield method. This emission drive sequence is disclosed in, for example, Japanese Patent Application Kokai (Laid-Open Publication) No. 2000-227778.

The light emission drive sequence shown in FIG. 1 divides a single field period into 14 subfields, which are the subfields SF1 to SF14. All the discharge cells of the PDP are initialized in lit mode only in the leading subfield SF1 of these subfields SF1 to SF14 (Rc). Each of the subfields SF1 to SF14 sets some of the discharge cells to unlit mode in accordance with the video input signal (Wc) and causes only the discharge cells of lit mode to discharge light over the period allocated to the subfield concerned (Ic).

FIG. 2 of the attached drawings shows an example of a light emission drive pattern in a single field period of each discharge cell that is driven on the basis of this light emission drive sequence (see Japanese Patent Application Kokai No. 2000-2277785).

According to the light emission pattern shown in FIG. 2, the discharge cells initialized in lit mode in the leading subfield SF1 are then set to unlit mode in a particular one subfield of the subfields SF1 to SF14, as indicated by the black circles. Once the discharge cell is set to unlit mode, the discharge cell does not re-enter lit mode until the one field period ends. Accordingly, during the period until the discharge cells are set to unlit mode, as indicated by the white circles, the discharge cells discharge light continuously in these subfields. Here, each of the fifteen different light emission patterns shown in FIG. 2 has a different total light emission period within a single field period, and hence fifteen different intermediate luminances are rendered. That is, an intermediate luminance display for (N+1) grayscales (N being the number of subfields) is feasible.

However, with this driving method, because there are restrictions on the number of subfields, there is a shortage in the number of grayscales. In order to compensate for the shortage in the number of grayscales, multiple gtayscale processing such as error diffusion and dither processing is performed on the video input signal.

Error diffusion processing converts the video input signal into 8-bit pixel data, for example, for each pixel. The upper 6 bits of the pixel data is treated as display data and the remaining lower two bits of the pixel data is treated as error data. Then, the error data of the pixel data are weighted and added based on the respective peripheral pixels and the resultant is reflected in the display data. As a result of this operation, a pseudo-representation of the luminance of the lower two bits of the original pixel is provided by the peripheral pixels, and, consequently, a luminance grayscale representation of the 8 bits of pixel data is possible by means of the six bits of display data. Further, dither processing is performed on the six-bit error-diffusion-processed pixel data obtained by the error diffusion processing. In dither processing, a single pixel unit is rendered from a plurality of adjoining pixels, and dither coefficients consisting of different coefficient values are allocated and added to the error-diffusion-processed pixel data corresponding with the respective pixels in the single pixel unit. As a result of the addition of the dither coefficients, when viewed in the single pixel unit, the luminance of the 8-bit original data can be represented by only the upper four bits of the dither-added pixel data. Therefore, the upper four bits of the dither-added pixel data are extracted and allocated to each of the 15 different light emission patterns shown in FIG. 2 as multiple grayscale pixel data PDs.

However, in the case of a four row by four column dither pattern (when sixteen dither coefficients are used), for example, the dither pattern must be repeated in sixteen-field cycles in order to express all the luminance as viewed in a single pixel unit. Therefore, when multiple grayscale processing is to be performed by means of multiple bit-number compression, the recursive cycle becomes long. This means that the observed integration effect cannot be expected and the picture quality deteriorates.

SUMMARY OF THE INVENTION

One object of the present invention is to provide a display panel driver device capable of creating a favorable image display in which dither patterns are suppressed.

According to one aspect of the present invention, there is provided an improved driver device for driving a display panel. In the display panel, a plurality of pixel cells corresponding with pixels on display lines are arranged. The driver device drives the display panel in accordance with pixel data corresponding with the pixels based on a video input signal. The display lines are divided into a plurality of display line groups. Each display line group includes N adjacent display lines. N is an integer greater than one. The driver device includes a light emission driver for driving the pixel cells on the display lines in each display line group to emit light in accordance with the pixel data, at respectively different luminance levels based on a selected dither pattern. The dither pattern includes N weighting values allocated to the respective display lines of the display line group. The driver device also includes a dither pattern generating circuit for selecting, sequentially and in predetermined periods, one of M different dither patterns. M is an integer less than N.

These and other objects, aspects and advantages of the present invention will become apparent to those skilled in the art from the following detailed description and appended claims when read and understood in conjunction with the attached drawings.

BRIEF DESCRIPTION OF THE DRAWINGS

FIG. 2 shows an example of light emission drive patterns in a single field period of respective discharge cells driven on the basis of the light emission drive sequence shown in FIG. 1;

FIG. 6 shows a data conversion table used by a drive data conversion circuit shown in FIG. 3;

FIGS. 7A to 7D show light emission drive sequences according to an embodiment of the present invention;

FIG. 8 shows light emission drive patterns based on the light emission drive sequence shown in FIG. 7A;

FIG. 9 shows light emission drive patterns based on the light emission drive sequence shown in FIG. 7B;

FIG. 10 shows light emission drive patterns based on the light emission drive sequence shown in FIG. 7C;

FIG. 11 shows light emission drive patterns based on the light emission drive sequence shown in FIG. 7D;

DETAILED DESCRIPTION OF THE INVENTION

A description of a drive device for driving a plasma display panel (PDP) based on a driving method of one embodiment of the present invention will now be provided with reference to FIG. 3 to FIG. 14.

Figure 1:
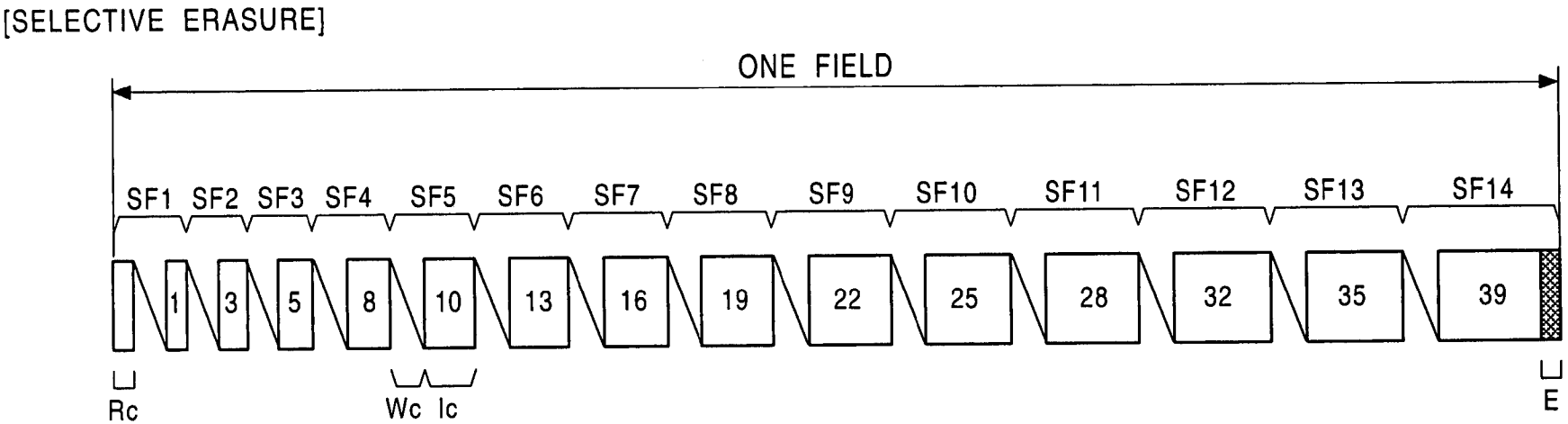
FIG. 1 shows an example of a light emission drive sequence based on the subfield method.
Figure 3:
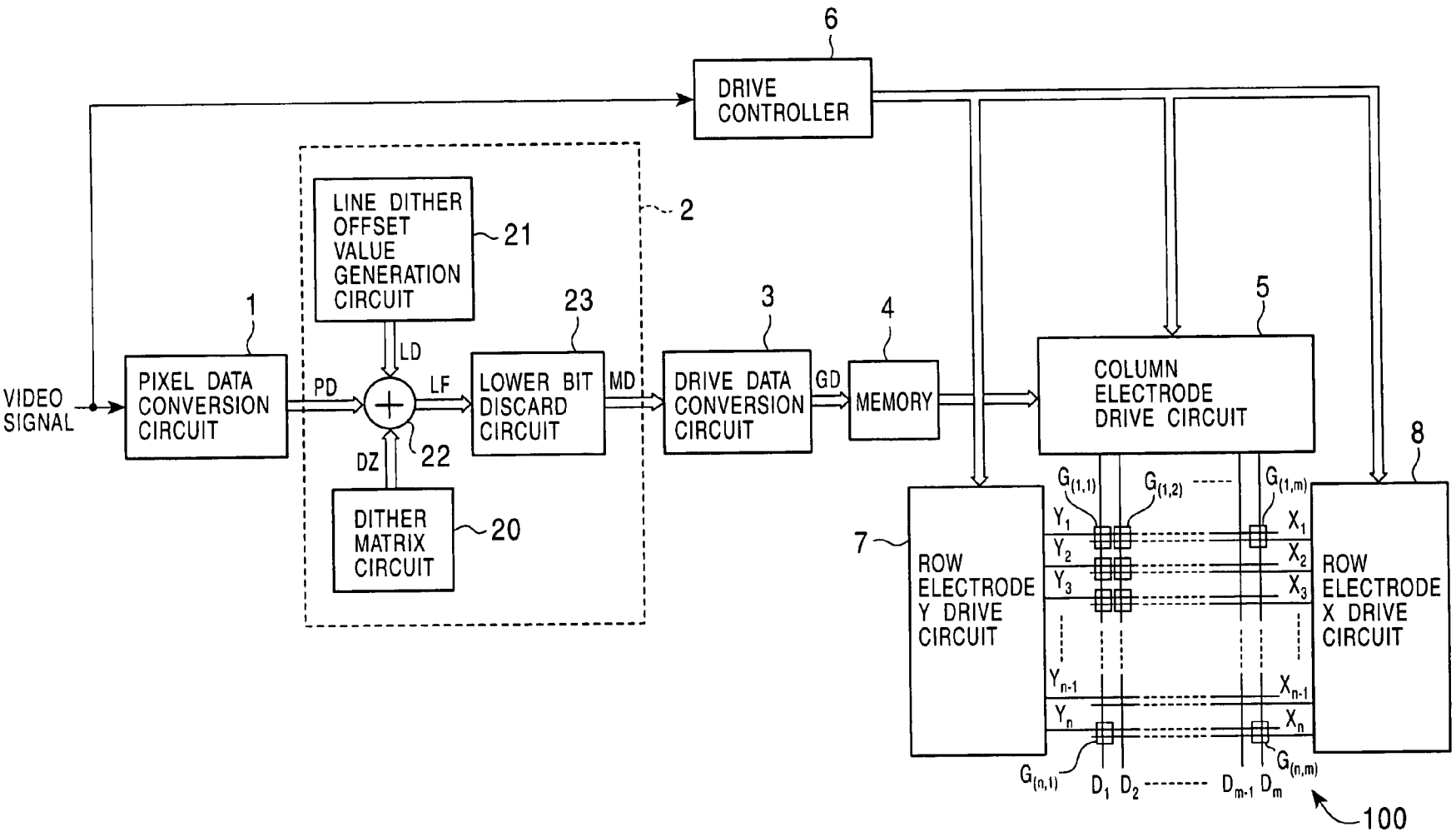
FIG. 3 schematically shows the constitution of a plasma display device that has the driver device according to one embodiment of the present invention.
Figures 4A, 4B, 4C, 4D:
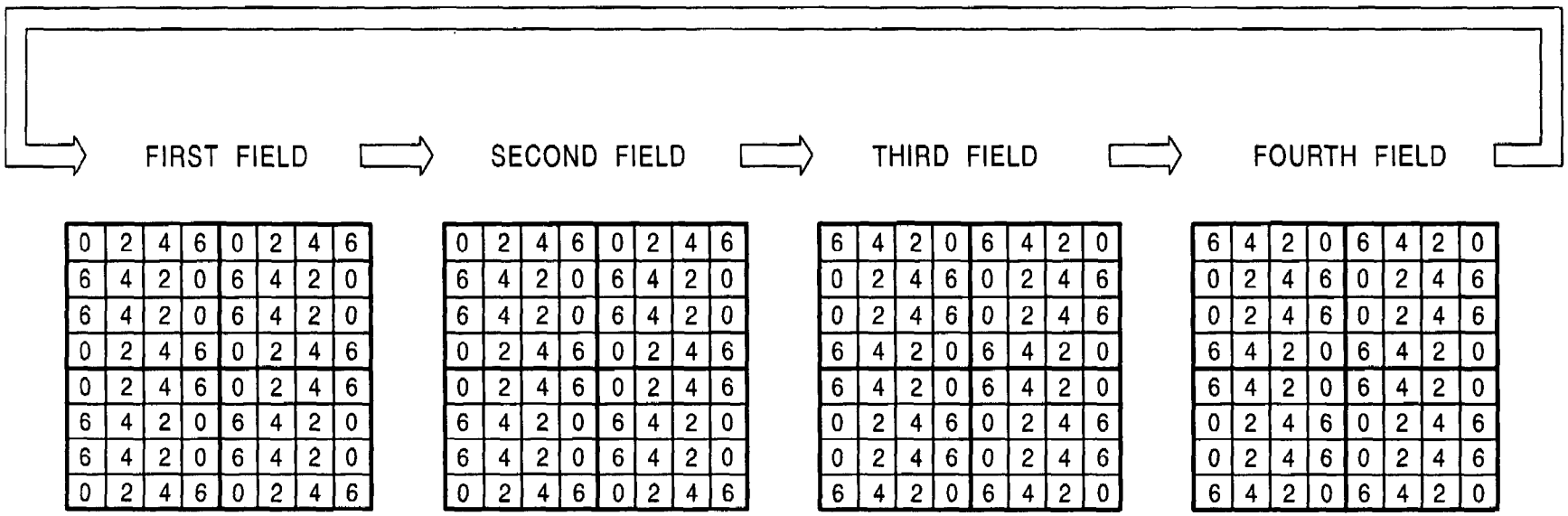
FIGS. 4A to 4D show pixel dither values for different fields, respectively.

Referring to FIG. 3, the PDP 100 includes a front-side substrate (not shown) that functions as a display surface, and a rear-side substrate (not shown) that is disposed in a position opposite the front-side substrate. A discharge space filled with discharge gas is defined between the front-side substrate and rear-side substrate. Belt-shaped row electrodes $X_1$ to $X_n$ and row electrodes $Y_1$ to $Y_n$ are alternately arranged in parallel to each other and provided on the front-side substrate. Belt-shaped column electrodes $D_1$ to $D_m$ arranged to cross over the row electrodes are provided on the rear-side substrate. The row electrodes $X_1$ to $X_n$ and $Y_1$ to $Y_n$ are arranged such that the first to nth display lines of the PDP 100 are defined by n pairs of row electrodes $X_i$ and $Y_i$. Discharge cells G serving as pixels are formed at the intersection points (including the discharge space) between the row electrode pairs and column electrodes. That is, (n×m) discharge cells $G_{(1,1)}$ to $G_{(n,m)}$ are formed in a matrix shape on the PDP 100.

The pixel data conversion circuit 1 converts a video input signal into 6-bit pixel data PD, for example, for each pixel and supplies this pixel data PD to a multiple grayscale processing circuit 2. The multiple grayscale processing circuit 2 includes a dither matrix circuit 20, a line dither offset value generation circuit 21, an adder 22, and a lower bit discard circuit 23.

The dither matrix circuit 20 prepares (generates) '0', '2', '4' and '6' (expressed in decimal system) pixel dither values DZ as shown in FIGS. 4A to 4D in correspondence with pixel positions in each of the pixel groups. Each pixel group (region circled by the solid lines) includes adjacent pixels arranged in an area of four rows and four columns. The dither matrix circuit 20 then supplies these pixel dither values DZ to the adder 22. As seen in FIGS. 4A to 4D, the dither matrix circuit 20 allocates the sixteen pixel dither values DZ for the sixteen pixels in each pixel group, respectively, and changes these values DZ for every two fields of the video input signal.

The line dither offset value generation circuit 21 first generates eight line dither offset values LD with the values '0' to '7' respectively to match eight display line groups. The first to nth display lines of the PDP 100 are divided into the eight groups by picking up the display lines by eight lines. That is, the (8N−7)th display line group consisting of the 1st, 9th, 17th, . . . , (n−7)th display lines;

the (8N−6)th display line group consisting of the 2nd, 10th, 18th, . . . , and (n−6)th display lines;

the (8N−5)th display line group consisting of the 3rd, 11th, 19th, . . . , and (n−5)th display lines;

the (8N−4)th display line group consisting of the 4th, 12th, 20th, . . . , and (n−4)th display lines;

the (8N−3)th display line group consisting of the 5th, 13th, 21st, . . . , and (n−3)th display lines;

the (8N−2)th display line group consisting of the 6th, 14th, 22nd, . . . , and (n−2)th display lines;

the (8N−1)th display line group consisting of the 7th, 15th, 23rd, . . . , and (n−1)th display lines; and the (8N)th display line group consisting of the 8th, 16th, 24th, . . . , and nth display lines where N is a natural number equal to or less than (⅛)·n.

The line dither offset value generation circuit 21 changes, for each field and with 4 fields forming one cycle, the allocation to the display line groups of the line dither offset values LD, as shown in FIGS. 5A to 5D.

Figures 5A, 5B, 5C, 5D:
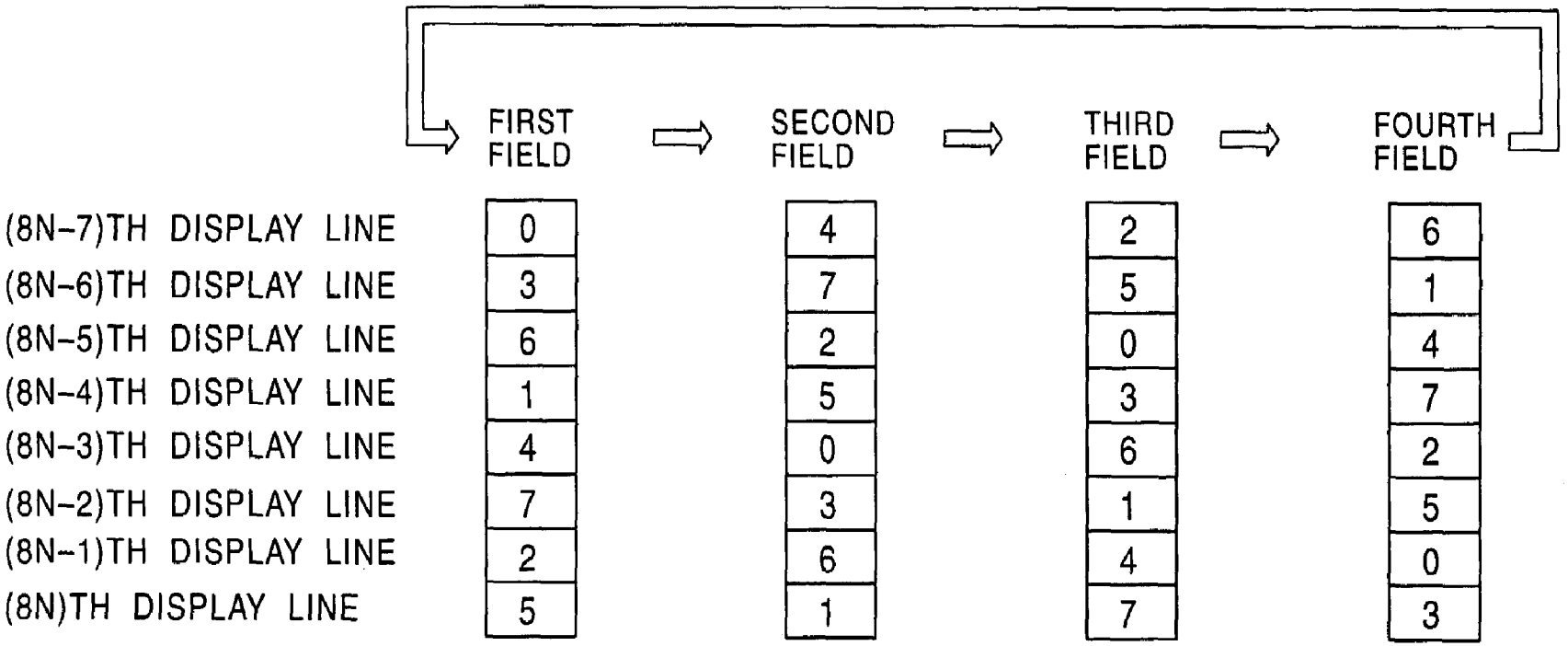
FIGS. 5A to 5D show line dither offset values for different fields, respectively.

Specifically, as shown in FIG. 5A, the line dither offset value generation circuit 21 allocates, in the first field, the following line dither offset values LD to the eight display line groups:

value LD '0' to the (8N−7)th display line group,
value LD '3' to the (8N−6)th display line group,
value LD '6' to the (8N−5)th display line group,
value LD '1' to the (8N−4)th display line group,
value LD '4' to the (8N−3)th display line group,
value LD '7' to the (8N−2)th display line group,
value LD '2' to the (8N−1)th display line group, and
value LD '5' to the (8N)th display line group.

As shown in FIG. 5B, the line dither offset values LD with the following values are allocated in the second field:

value LD '4' to the (8N−7)th display line group;
value LD '7' to the (8N−6)th display line group;
value LD '2' to the (8N−5)th display line group;
value LD '5' to the (8N−4)th display line group;
value LD '0' to the (8N−3)th display line group;
value LD '3' to the (8N−2)th display line group;
value LD '6' to the (8N−1)th display line group; and
value LD '1' to the (8N)th display line group.

As shown in FIG. 5C, the line dither offset values LD with the following values are allocated in the third field:

value LD '2' to the (8N−7)th display line group;
value LD '5' to the (8N−6)th display line group;
value LD '0' to the (8N−5)th display line group;
value LD '3' to the (8N−4)th display line group;
value LD '6' to the (8N−3)th display line group;
value LD '1' to the (8N−2)th display line group;
value LD '4' to the (8N−1)th display line group; and
'7' to the (8N)th display line group.

As shown in FIG. 5D, the line dither offset values LD with the following values are allocated in the fourth field:

value LD '6' to the (8N−7)th display line group;
value LD '1' to the (8N−6)th display line group;
value LD '4' to the (8N−5)th display line group;
value LD '7' to the (8N−4)th display line group;

value LD '2' to the (8N−3)th display line group;

value LD '5' to the (8N−2)th display line group;

value LD '0' to the (8N−1)th display line group; and value LD '3' to the (8N)th display line group.

The line dither offset value generation circuit 21 provides the adder 22 with the line dither offset values LD allocated to the display lines belonging to discharge cells corresponding with the pixel data PD supplied by the pixel data conversion circuit 1.

Upon receiving the pixel data PD from the pixel data conversion circuit 1, the adder 22 adds the pixel dither values DZ, which correspond with the pixel data PD, and the associated line dither offset values LD to the pixel data PD to obtain dither added pixel data LF. Then, the adder 22 provides the lower bit discard circuit 23 with the dither added pixel data LF. The lower bit discard circuit 23 discards the lower three bits' worth of the dither added pixel data LF and then supplies the remaining three upper bits' worth of this data LF to the drive data conversion circuit 3 as multiple grayscale pixel data MD.

A drive data conversion circuit 3 converts multiple grayscale pixel data MD into 4-bit (0th bit, first bit, second bit and third bit) pixel drive data GD in accordance with a data conversion table shown in FIG. 6 and supplies the four-bit pixel drive data GD to a memory 4.

The memory 4 sequentially captures and stores the 4-bit pixel drive data GD. Each time the memory 4 finishes the writing of one image-frame (n rows×m columns) of pixel drive data $GD_{1,1}$ to $GD_{n,m}$, the memory 4 divides the pixel drive data $GD_{1,1}$ to $GD_{n,m}$ into bit digits (0th to 3rd bits) and reads one display line's worth of this data at a time in correspondence with the subfields SF0 to SF3 respectively. The memory 4 supplies m pixel drive data bits corresponding to one display line to a column electrode driver circuit 5 as the pixel drive data bits DB1 to DBm.

That is, in the subfield SF0, the memory 4 reads only the 0th bit of each of the pixel drive data $GD_{1,1}$ to $GD_{n,m}$ one display line at a time, and supplies the respective 0th bits to the column electrode driver circuit 5 as the pixel drive data bits DB1 to DBm. In the next subfield (i.e., subfield SF1), the memory 4 reads, one display line at a time, only the respective first bits of pixel drive data $GD_{1,1}$ to $GD_{n,m}$ and supplies these first bits to the column electrode driver circuit 5 as the pixel drive data bits DB1 to DBm. Next, in the subfield SF2, the memory 4 reads only the respective second bits of the pixel drive data $GD_{1,1}$, to $GD_{n,m}$ one display line at a time and supplies these second bits to the column electrode driver circuit 5 as pixel drive data bits DB1 to DBm. Subsequently, in the subfield SF3, the memory 4 reads only the respective third bits of the pixel drive data $GD_{1,1}$ to $GD_{n,m}$ one display line at a time and supplies these third bits to the column electrode driver circuit 5 as pixel drive data bits DB1 to DBm.

A drive control circuit 6 generates various timing signals for grayscale-driving of the PDP 100 in accordance with the light emission drive sequences shown in the following drawings:

the first subfield: drive sequence shown in FIG. 7A;

the second subfield: drive sequence shown in FIG. 7B;

the third subfield: drive sequence shown in FIG. 7C; and the fourth subfield: drive sequence shown in FIG. 7D.

The drive control circuit 6 supplies these timing signals to the column electrode driver circuit 5, the row electrode Y driver circuit 7 and the row electrode X driver circuit 8 respectively. A series of driving shown in FIGS. 7A to 7D is executed repeatedly.

The column electrode driver circuit 5, the row electrode Y driver circuit 7, and the row electrode X driver circuit 8 generate various drive pulses (not shown) to drive the PDP 100 as described below in accordance with the timing signals supplied by the drive control circuit 6, and apply these drive pulses to the column electrodes $D_1$ to $D_m$, row electrodes $X_1$ to $X_n$, and row electrodes $Y_1$ to $Y_n$ of the PDP 100, respectively.

It should be noted that in the light emission drive sequence shown in FIGS. 7A to 7D, each of the fields of the video input signal is constituted by the five subfields SF0 to SF4.

The leading subfield SF0 sequentially executes a reset step R and an address step W0. The reset step R causes all the discharge cells $G_{(1,1)}$ to $G_{(n,m)}$ of the PDP 100 to perform a reset discharge all together and initializes the discharge cells $G_{(1,1)}$ to $G_{(n,m)}$ in a lit mode (state in which a wall charge of a predetermined amount is formed). In the address step W0, the discharge cells G arranged on the first to nth display lines of the PDP 100 are selectively made to perform an erase discharge in accordance with the pixel drive data GD as shown in FIG. 6, in sequence one display line at a time, so that the selected discharge cells are brought into an unlit mode (state where the wall charge has been erased or extinguished). The discharge cells in which the erasure discharge is not induced in this address step W0 retain the state up until immediately before this address step W0, that is, the lit mode.

Each of the subfields SF1 to SF3 are further divided into eight subfields $SF1_1$ to $SF1_8$, $SF2_1$ to $SF2_8$, and $SF3_1$ to $SF3_8$ respectively. Address steps W1 to W8 are executed in the subfields $SF1_1$ to $SF1_8$, $SF2_1$ to $SF2_8$, and $SF3_1$ to $SF3_8$ respectively.

In the address step W1, only discharge cells that are arranged in the (8N−7)th display lines (i.e., the 1st, 9th, 17th, . . . , and (n−7)th display lines) among all the discharge cells $G_{(1,1)}$ to $G_{(n,m)}$ in the PDP 100, are selectively caused to perform an erasure discharge in accordance with the pixel drive data. As a result, discharge cells in which an erasure discharge is induced are set to the unlit mode, and discharge cells in which an erasure discharge is not induced retain the state up until immediately before the address step W1. That is, the address step W1 sets the discharge cells arranged on the (8N−7)th display lines to either the unlit or lit mode in accordance with the pixel drive data.

In the address step W2, only the discharge cells arranged on the (8N−6)th display lines (i.e., the 2nd, 10th, 18th, and (n−6)th display lines) are selectively made to perform an erasure discharge in accordance with the pixel drive data. As a result, discharge cells in which an erasure discharge is induced are set to the unlit mode, and discharge cells in which an erasure discharge is not induced retain the state up until immediately before the address step W2. That is, the address step W2 sets the discharge cells arranged on the (8N−6)th display lines to either the unlit mode or the lit mode in accordance with the pixel drive data.

In the address step W3, only discharge cells arranged on the (8N−5)th display lines (i.e., the 3rd, 11th, 19th, . . . , and (n−5)th display lines) are selectively made to perform an erasure discharge in accordance with the pixel drive data. As a result, discharge cells in which an erasure discharge is induced are set to the unlit mode, and discharge cells in which an erasure discharge is not induced retain the state up until directly before the address step W3. That is, the address step W3 sets the discharge cells arranged on the (8N−5)th display lines to either the unlit or lit mode in accordance with the pixel drive data.

In the address step W4, only discharge cells arranged on the (8N−4)th display lines (i.e., the 4th, 12th, 20th, . . . , and (n−4)th display lines) are selectively made to perform an erasure discharge in accordance with the pixel drive data. As a result, discharge cells in which an erasure discharge is induced are set to the unlit mode, and discharge cells in which an erasure discharge is not induced retain the state up until directly before the address step W4. That is, the address step W4 sets the discharge cells arranged on the (8N−4)th display lines to either the unlit or lit mode in accordance with the pixel drive data.

In the address step W5, only discharge cells arranged on the (8N−3)th display lines (i.e., the 5th, 13th, 21st, . . . , and (n−3)th display lines) are selectively made to perform an erasure discharge in accordance with the pixel drive data. As a result, discharge cells in which an erasure discharge is induced are set to the unlit mode, and discharge cells in which an erasure discharge is not induced retain the state up until directly before the address step W5. That is, the address step W5 sets the discharge cells arranged on the (8N−3)th display lines to either the unlit or lit mode in accordance with the pixel drive data.

In the address step W6, only discharge cells arranged on the (8N−2)th display lines (i.e., the 6th, 14th, 22nd, . . . , and (n−2)th display lines) are selectively made to perform an erasure discharge in accordance with the pixel drive data. As result, discharge cells in which an erasure discharge is induced are set to the unlit mode, and discharge cells in which an erasure discharge is not induced retain the state up until directly before the address step W6. That is, the address step W6 sets the discharge cells arranged on the (8N−2)th display lines to either the unlit or lit mode in accordance with the pixel drive data.

In the address step W7, only discharge cells arranged on the (8N−1)th display lines (i.e., the 7th, 15th, 23rd, . . . , and (n−1)th display lines) are selectively made to perform an erasure discharge in accordance with the pixel drive data. Discharge cells in which an erasure discharge is induced are set to the unlit mode, and discharge cells in which an erasure discharge is not induced retain the state up until directly before the address step W7. That is, the address step W7 sets the discharge cells arranged on the (8N−1)th display lines to either the unlit or lit mode in accordance with the pixel drive data.

In the address step W8, only discharge cells arranged on the (8N)th display lines (i.e., the 8th, 16th, 24th, . . . , and nth display lines) are selectively made to perform an erasure discharge in accordance with the pixel drive data. Discharge cells in which an erasure discharge is induced are set to the unlit mode, and discharge cells in which an erasure discharge is not induced retain the state up until directly before the address step W8. That is, the address step W8 sets the discharge cells arranged on the (8N)th display lines to either the unlit or lit mode in accordance with the pixel drive data.

In the light emission drive sequence shown in FIG. 7A, the following address steps are executed in the subfields:

the address step W6 in the subfields $SF1_1$, $SF2_1$, $SF3_1$ respectively;

the address step W3 in the subfields $SF1_2$, $SF2_2$, $SF3_2$ respectively;

the address step W8 in the subfields $SF1_3$, $SF2_3$, $SF3_3$ respectively;

the address step W5 in the subfields $SF1_4$, $SF2_4$, $SF3_4$ respectively;

the address step W2 in the subfields $SF1_5$, $SF2_5$, $SF3_5$ respectively;

the address step W7 in the subfields $SF1_6$, $SF2_6$, $SF3_6$ respectively;

the address step W4 in the subfields $SF1_7$, $SF2_7$, $SF3_7$ respectively; and the address step W1 in the subfields $SF1_8$, $SF2_8$, $SF3_8$ respectively.

In the light emission drive sequence shown in FIG. 7B, the following address steps are executed in the subfields:

the address step W2 in the subfields $SF1_1$, $SF2_1$, $SF3_1$ respectively;

the address step W7 in the subfields $SF1_2$, $SF2_2$, $SF3_2$ respectively;

the address step W4 in the subfields $SF1_3$, $SF2_3$, $SF3_3$ respectively;

the address step W1 in the subfields $SF1_4$, $SF2_4$, $SF3_4$ respectively;

the address step W6 in the subfields $SF1_5$, $SF2_5$, $SF3_5$ respectively;

the address step W3 in the subfields $SF1_6$, $SF2_6$, $SF3_6$ respectively;

the address step W8 in the subfields $SF1_7$, $SF2_7$, $SF3_7$, respectively; and the address step W5 in the subfields $SF1_8$, $SF2_8$, $SF3_8$ respectively.

In the light emission drive sequence shown in FIG. 7C, the following address steps are executed in the subfields:

the address step W8 in the subfields $SF1_1$, $SF2_1$, $SF3_1$ respectively;

the address step W5 in the subfields $SF1_2$, $SF2_2$, $SF3_2$ respectively;

the address step W2 in the subfields $SF1_3$, $SF2_3$, $SF3_3$ respectively;

the address step W7 in the subfields $SF1_4$, $SF2_4$, $SF3_4$ respectively;

the address step W4 in the subfields $SF1_5$, $SF2_5$, $SF3_5$ respectively;

the address step W1 in the subfields $SF1_6$, $SF2_6$, $SF3_6$ respectively;

the address step W6 in the subfields $SF1_7$, $SF2_7$, $SF3_7$ respectively; and the address step W3 in the subfields $SF1_8$, $SF2_8$, $SF3_8$ respectively.

In the light emission drive sequence shown in FIG. 7D, the following address steps are executed in the subfields:

the address step W4 in the subfields $SF1_1$, $SF2_1$, $SF3_1$ respectively;

the address step W1 in the subfields $SF1_2$, $SF2_2$, $SF3_2$ respectively;

the address step W6 in the subfields $SF1_3$, $SF2_3$, $SF3_3$ respectively;

the address step W3 in the subfields $SF1_4$, $SF2_4$, $SF3_4$ respectively;

the address step W8 in the subfields $SF1_5$, $SF2_5$, $SF3_5$ respectively;

the address step W5 in the subfields $SF1_6$, $SF2_6$, $SF3_6$ respectively;

the address step W2 in the subfields $SF1_7$, $SF2_7$, $SF3_7$ respectively; and the address step W7 in the subfields $SF1_8$, $SF2_8$, $SF3_8$ respectively.

In each of the subfields $SF1_1$ to $SF1_8$, $SF2_1$ to $SF2_8$, and $SF3_1$ to $SF3_8$, a sustain step I, which causes only the discharge cells set to the lit mode to discharge light continuously over the period '1', is executed directly before the respective address steps W1 to W8.

In the final subfield SF4, only the sustain step I, which causes the discharge cells set to the lit mode to discharge light continuously over the period '1', is executed.

The drive control circuit 6 performs light emission driving as shown in FIGS. 8 to 11 in accordance with the light emission drive sequences shown in FIGS. 7A to 7D.

FIG. 8 shows light emission drive patterns based on the light emission drive sequence in FIG. 7A;

FIG. 9 shows light emission drive patterns based on the light emission drive sequence in FIG. 7B;

FIG. 10 shows light emission drive patterns based on the light emission drive sequence in FIG. 7C; and FIG. 11 shows light emission drive patterns based on the light emission drive sequence in FIG. 7D.

When '1000' pixel drive data GD, which represents the lowest luminance, is supplied, a light emission display based on first grayscale driving is executed. Because the 0th bit of the pixel drive data GD is logic level 1, an erasure discharge (indicated by the black circles) is induced in the discharge cells in the address step W0 of the subfield SF0, and the discharge cells become the unlit mode. According to the driving scheme shown in FIGS. 7A to 7D, the opportunity, in a single field display period, for discharge cells to shift from the unlit mode to the lit mode arises only in the reset step R of the leading subfield SF0. Accordingly, discharge cells that have become the unlit mode retain the unlit state in the course of the single field display period.

Figure 12:
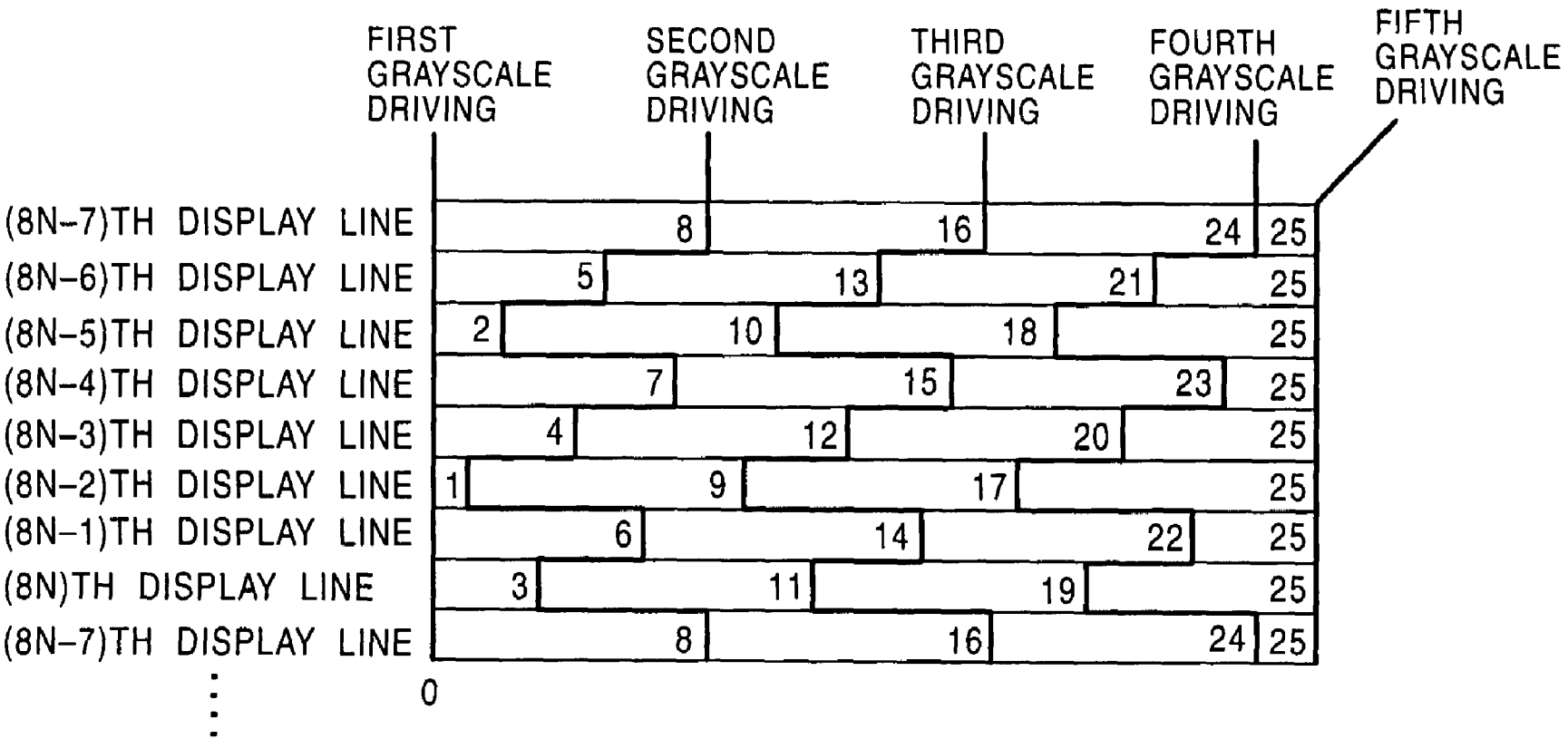
FIG. 12 depicts, for each display line, the luminance level of the first to fifth grayscale driving respectively.

In other words, in the first grayscale driving in accordance with the '1000' pixel drive data GD, each discharge cell retains an unlit state in the course of a single field display period, thereby achieving the luminance level (brightness level) 0 as shown in FIG. 12.

When '0100' pixel drive data GD representing a luminance one level higher than that of the '1000' pixel drive data is supplied, a light emission display based on second grayscale driving is implemented. Because the first bit of the pixel drive data GD is logic level 1, an erasure discharge (indicated by overlapping circles) is induced in the discharge cells in the address steps W1 to W8 of the subfield SF1. Thereupon, because discharge cells are initialized in the lit mode in the reset step R of the leading subfield SF0, sustained discharge light emission is implemented continuously in the sustain steps I that exist in the interval up until the erasure discharge is induced. For example, in the light emission drive sequence shown in FIG. 7A, the address steps are executed as follows:

Address step W6, which performs erasure discharge on the (8N−7)th display line group, is executed in the subfield $SF1_1$;

Address step W3, which performs erasure discharge on the (8N−6)th display line group, is executed in the subfield $SF1_2$;

Address step W8, which performs erasure discharge on the (8N−5)th display line group, is executed in the subfield $SF1_3$;

Address step W5, which performs erasure discharge on the (8N−4)th display line group, is executed in the subfield $SF1_4$;

Address step W2, which performs erasure discharge on the (8N−3)th display line group, is executed in the subfield $SF1_5$;

Address step W7, which performs erasure discharge on the (8N−2)th display line group, is executed in the subfield $SF1_6$;

Address step W4, which performs erasure discharge on the (8N−1)th display line group, is executed in the subfield $SF1_7$; and Address step W1, which performs erasure discharge on the (8N)th display line group, is executed in the subfield $SF1_8$.

Accordingly, as indicated by the white and overlapping circles in FIG. 8, the discharge cells perform a sustained discharge continuously in the sustain steps I of the following subfields:

Subfields $SF1_1$ to $SF1_8$ for the (8N−7)th display line;
Subfields $SF1_1$ to $SF1_5$ for the (8N−6)th display line;
Subfields $SF1_1$ to $SF1_2$ for the (8N−5)th display line;
Subfields $SF1_1$ to $SF1_7$ for the (8N−4)th display line;
Subfields $SF1_1$ to $SF1_4$ for the (8N−3)th display line;
Subfield $SF1_1$ for the (8N−2)th display line;
Subfields $SF1_1$ to $SF1_6$ for the (8N−1)th display line; and
Subfields $SF1_1$ to $SF1_3$ for the (8N)th display line.

That is, in the second grayscale driving in accordance with the '0100' pixel drive data GD, the discharge cells arranged on each display line are each driven at a luminance level corresponding with the period of the light emission produced by the sustained discharge induced in the course of a single field display period, as shown in FIG. 12. Specifically, the discharge cells arranged on the (8N−7)th display line are at the luminance level '8';

the discharge cells arranged on the (8N−6)th display lines are at the luminance level '5';

the discharge cells arranged on the (8N−5)th display lines are at the luminance level '2';

the discharge cells arranged on the (8N−4)th display lines are at the luminance level '7';

the discharge cells arranged on the (8N−3)th display lines are at the luminance level '4';

the discharge cells arranged on the (8N−2)th display lines are at the luminance level '1';

the discharge cells arranged on the (8N−1)th display lines are at the luminance level '6'; and the discharge cells arranged on the (8N)th display lines are at the luminance level '3'.

When '0010' pixel drive data GD representing a luminance one level higher than that of the '0100' pixel drive data is supplied, a light emission display based on third grayscale driving is performed. Because the second bit of the pixel drive data GD is logic level 1, an erasure discharge (indicated by overlapping circles) is induced in each discharge cell in the address steps W1 to W8 of the subfield SF2. The discharge cells are initialized in the lit mode in the reset step R of the leading subfield SF0, so that sustained discharge light emission is executed continuously in the sustain steps I that exist during the interval up until the erasure discharge is induced. For example, in the light emission drive sequence shown in FIG. 7A, the address steps are executed as follows:

address step W6, which performs erasure discharge on the (8N−7)th display line group, is executed in the subfield $SF2_1$;

address step W3, which performs erasure discharge on the (8N−6)th display line group, is executed in the subfield $SF2_2$;

address step W8, which performs erasure discharge on the (8N−5)th display line group, is executed in the subfield $SF2_3$;

address step W5, which performs erasure discharge on the (8N−4)th display line group, is executed in the subfield $SF2_4$;

address step W2, which performs erasure discharge on the (8N−3)th display line group, is executed in the subfield $SF2_5$;

address step W7, which performs erasure discharge on the (8N−2)th display line group, is executed in the subfield $SF2_6$;

address step W4, which performs erasure discharge on the (8N−1)th display line group, is executed in the subfield $SF2_7$; and address step W1, which performs erasure discharge on the (8N)th display line group, is executed in the subfield $SF2_8$.

Accordingly, as indicated by the white and overlapping circles in FIG. 8, the discharge cells perform a sustained discharge continuously in the sustain steps I of the following subfields:

the (8N−7)th display line in the subfields $SF1_1$ to $SF1_8$ and the subfields $SF2_1$ to $SF2_8$;

the (8N−6)th display line in the subfields $SF1_1$ to $SF_8$ and the subfields $SF2_1$ to $SF2_5$;

the (8N−5)th display line in the subfields $SF1_1$ to $SF1_8$ and the subfields $SF2_1$ to $SF2_2$;

the (8N−4)th display line in the subfields $SF1_1$ to $SF1_8$ and the subfields $SF2_1$ to $SF2_7$;

the (8N−3)th display line in the subfields $SF1_1$ to $SF1_8$ and the subfields $SF2_1$ to $SF2_4$;

the (8N−2)th display line in the subfields $SF1_1$ to $SF1_8$ and the subfield $SF2_1$;

the (8N−1)th display line in the subfields $SF1_1$ to $SF1_8$, and the subfields $SF2_1$ to $SF2_6$;

the (8N)th display line in the subfields $SF1_1$ to $SF1_{81}$ and the subfields $SF2_1$ to $SF2_3$.

That is, in the third grayscale driving in accordance with the '0010' pixel drive data GD, the discharge cells arranged on each display line are each driven at a luminance level corresponding with the period of the light emission produced by the sustained discharge induced in the course of a single field display period, as shown in FIG. 12. Specifically, the discharge cells arranged on the (8N−7)th display lines are at the luminance level '16';

the discharge cells arranged on the (8N−6)th display lines are at the luminance level '13';

the discharge cells arranged on the (8N−5)th display lines are at the luminance level '10';

the discharge cells arranged on the (8N−4)th display lines are at the luminance level '15';

the discharge cells arranged on the (8N−3)th display lines are at the luminance level '12';

the discharge cells arranged on the (8N−2)th display lines are at the luminance level '9';

the discharge cells arranged on the (8N−1)th display lines are at the luminance level '14'; and the discharge cells arranged on the (8N)th display lines are at the luminance level '11'.

When '0001' pixel drive data GD representing a luminance one level higher than that of the '0010' pixel drive data is supplied, a light emission display based on fourth grayscale driving is performed as detailed below. Because the third bit of the pixel drive data GD is logic level 1, an erasure discharge (indicated by overlapping circles) is induced in each discharge cell in the address steps W1 to W8 of the subfield SF3. The discharge cells are initialized in the lit mode in the reset step R of the leading subfield SF0, so that sustained discharge light emission is executed continuously in the sustain steps I that exist during the interval up until the erasure discharge is induced. For example, in the light emission drive sequence shown in FIG. 7A, the address steps are executed as follows:

Address step W6, which performs erasure discharge on the (8N−7)th display line group, is executed in the subfield $SF3_1$;

Address step W3, which performs erasure discharge on the (8N−6)th display line group, is executed in the subfield $SF3_2$;

Address step W8, which performs erasure discharge on the (8N−5)th display line group, is executed in the subfield $SF3_3$;

Address step W5, which performs erasure discharge on the (8N−4)th display line group, is executed in the subfield $SF3_4$;

Address step W2, which performs erasure discharge on the (8N−3)th display line group, is executed in the subfield $SF3_1$;

Address step W7, which performs erasure discharge on the (8N−2)th display line group, is executed in the subfield $SF3_6$;

Address step W4, which performs erasure discharge on the (8N−1)th display line group, is executed in the subfield $SF3_7$; and Address step W1, which performs erasure discharge on the (8N)th display line group, is executed in the subfield $SF3_8$.

Accordingly, as indicated by the white and overlapping circles in FIG. 8, the discharge cells perform a sustained discharge continuously in the sustain steps I of the following subfields. Specifically, Subfields $SF1_1$ to $SF2_8$ and the subfields $SF3_1$ to $SF3_8$ for the (8N−7)th display line;

Subfields $SF1_1$ to $SF2_8$ and the subfields $SF3_1$ to SF3, for the (8N−6)th display line;

Subfields $SF1_1$ to $SF2_8$ and the subfields $SF3_1$ to $SF3_2$ for the (8N−5)th display line;

Subfields $SF1_1$ to $SF2_8$ and the subfields $SF3_1$ to SF3, for the (8N−4)th display line;

Subfields $SF1_1$ to $SF2_8$ and the subfields $SF3_1$ to $SF3_4$ for the (8N−3)th display line;

Subfields $SF1_2$, to $SF2_8$ and the subfield $SF3_1$ for the (8N−2)th display line;

Subfields $SF1_1$ to $SF2_8$, and the subfields $SF3_1$ to $SF3_6$ for the (8N−1)th display line;

Subfields $SF1_1$ to $SF2_8$, and the subfields $SF3_1$ to $SF3_3$ for the (8N)th display line.

That is, in the fourth grayscale driving in accordance with the '0001' pixel drive data GD, the discharge cells each emit light at a luminance level corresponding with the period of the light emission produced by the sustained discharge induced in the course of a single field display period, as shown in FIG. 12. Specifically, the discharge cells arranged on the (8N−7)th display lines are at the luminance level '24';

the discharge cells arranged on the (8N−6)th display lines are at the luminance level '21';

the discharge cells arranged on the (8N−5)th display lines are at the luminance level '18';

the discharge cells arranged on the (8N−4)th display lines are at the luminance level '23';

the discharge cells arranged on the (8N−3)th display lines are at the luminance level '20';

the discharge cells arranged on the (8N−2)th display lines are at the luminance level '17';

the discharge cells arranged on the (8N−1)th display lines are at the luminance level '22'; and the discharge cells arranged on the (8N)th display lines are at the luminance level '19'.

When '0000' pixel drive data GD representing the highest luminance is supplied, a light emission display based on the fifth grayscale driving is implemented. Because all the bits of the pixel drive data GD are logic level 0, erasure discharge is not induced at all during the single field display period. Accordingly, the discharge cells discharge light continuously in the sustain steps I of the subfields $SF1_1$ to $SF1_8$, $SF2_1$ to $SF2_8$, $SF3_1$ to $SF3_8$, and SF4.

That is, in the fifth grayscale driving in accordance with the '0000' pixel drive data GD, the discharge cells each emit light at a luminance level corresponding with the period of the light emission produced by the sustained discharge induced in the course of a single field display period as shown in FIG. 12. Specifically, the discharge cells arranged on the (8N−7)th display lines are at the luminance level '25';

the discharge cells arranged on the (8N−6)th display lines are at the luminance level '25';

the discharge cells arranged on the (8N−5)th display lines are at the luminance level '25';

the discharge cells arranged on the (8N−4)th display lines are at the luminance level '25';

the discharge cells arranged on the (8N−3)th display lines are at the luminance level '25';

the discharge cells arranged on the (8N−2)th display lines are at the luminance level '25';

the discharge cells arranged on the (8N−1)th display lines are at the luminance level '25'; and the discharge cells arranged on the (8N)th display lines are at the luminance level '25'.

Therefore, in the above described driving, the first to fifth grayscale driving that is capable of representing luminance corresponding to five levels is executed in accordance with five different pixel drive data GD, namely, '1000', '0100', '0010', '0001', and '0000'. Here, different luminance weightings are applied to eight adjacent display lines, and the eight adjacent display lines are driven at different luminance levels determined by the respective luminance weightings, in each of the first to fifth grayscale driving.

For example, the following luminance weightings ('1' to '8') are allocated to the eight adjacent display lines in the driving according to the light emission drive sequence for the first field shown in FIG. 7A:

(8N−7)th display line: luminance weighting '8';
(8N−6)th display line: luminance weighting '5';
(8N−5)th display line: luminance weighting '2';
(8N−4)th display line: luminance weighting '7';
(8N−3)th display line: luminance weighting '4';
(8N−2)th display line: luminance weighting '1';
(8N−1)th display line: luminance weighting '6'; and
(8N)th display line: luminance weighting '3'.

The following luminance weightings are allocated to the eight adjacent display lines in the driving according to the light emission drive sequence for the second field shown in FIG. 7B:

(8N−7)th display line: luminance weighting '4';
(8N−6)th display line: luminance weighting '1';
(8N−5)th display line: luminance weighting '6';
(8N−4)th display line: luminance weighting '3';
(8N−3)th display line: luminance weighting '8';
(8N−2)th display line: luminance weighting '5';
(8N−1)th display line: luminance weighting '2'; and
(8N)th display line: luminance weighting '7'.

The following luminance weightings are allocated to the eight adjacent display lines in the driving according to the light emission drive sequence for the third field shown in FIG. 7C:

(8N−7)th display line: luminance weighting '6';
(8N−6)th display line: luminance weighting '3';
(8N−5)th display line: luminance weighting '8';
(8N−4)th display line: luminance weighting '5';
(8N−3)th display line: luminance weighting '2';
(8N−2)th display line: luminance weighting '7';
(8N−1)th display line: luminance weighting '4'; and
(8N)th display line: luminance weighting '1'.

The following luminance weightings are allocated to the eight adjacent display lines in the driving according to the light emission drive sequence for the fourth field shown in FIG. 7D:

(8N−7)th display line: luminance weighting '2';
(8N−6)th display line: luminance weighting '7';
(8N−5)th display line: luminance weighting '4';
(8N−4)th display line: luminance weighting '1';
(8N−3)th display line: luminance weighting '6';
(8N−2)th display line: luminance weighting '3';
(8N−1)th display line: luminance weighting '8'; and
(8N)th display line: luminance weighting '5'.

As indicated by the light emission drive patterns shown in:

FIG. 8 for driving that corresponds with the light emission drive sequence of FIG. 7A;

FIG. 9 for driving that corresponds with the light emission drive sequence of FIG. 7B;

FIG. 10 for driving that corresponds with the light emission drive sequence of FIG. 7C; and FIG. 11 for driving that corresponds with the light emission drive sequence of FIG. 7D, the discharge cells arranged on the eight adjacent display lines are made to emit light at respective different luminance levels based on the above weightings. This is the line dither processing.

The actual drive operation executed in accordance with the video input signal will be described next by taking the driving in the first field as shown in FIG. 7A as an example.

Figure 13:
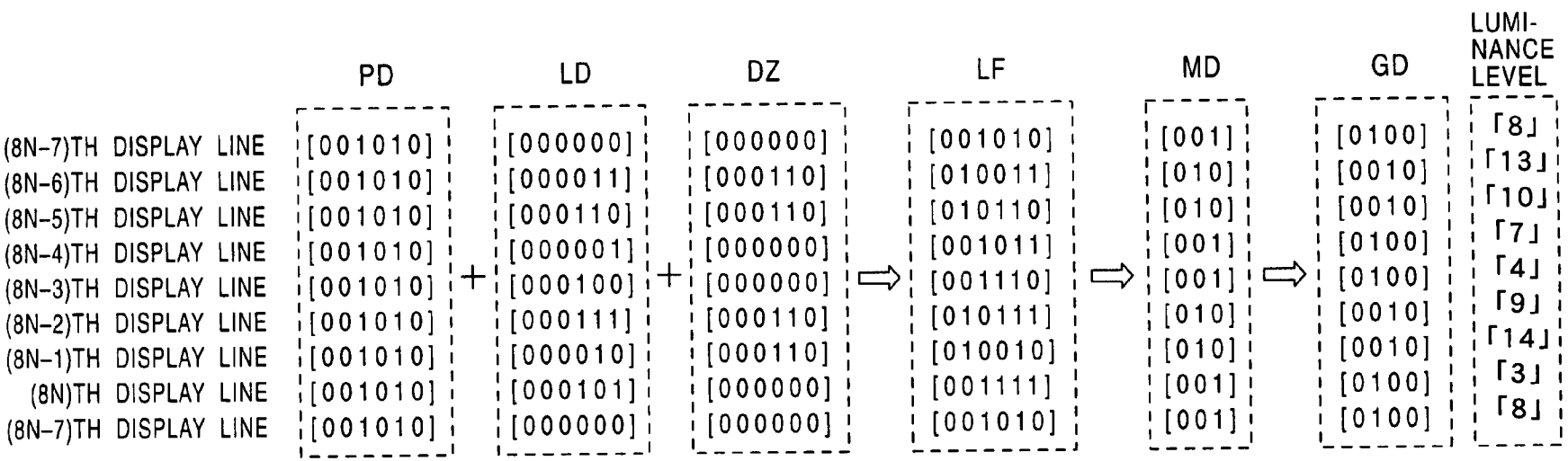
FIG. 13 illustrates the transition of the line dither weighting for each display line.

For example, when the 6-bit pixel data PD corresponding with one column's worth of discharge cells belonging to each of the eight adjacent display lines are all '001010', the adder 22 adds the line dither offset values LD shown in FIG. 5A to each of the pixel data PD, as shown in FIG. 13. The adder 22 also adds each of the values '0', '6', '6', '0', '0', '6', '6', '0', for example, which are pixel dither values DZ shown in FIG. 4A, to the pixel data PD of the respective display lines as shown in FIG. 13. As a result of this addition of line dither offset values LD and pixel dither values DZ, the following dither added pixel data LF are obtained for each of the display lines, as shown in FIG. 13:

(8N−7)th display line: value LF '001010';
(8N−6)th display line: value LF '010011';
(8N−5)th display line: value LF '010110';
(8N−4)th display line: value LF '001011';
(8N−3)th display line: value LF '001110';
(8N−2)th display line: value LF '010111';
(8N−1)th display line: value LF '010010'; and
(8N)th display line: value LF '001111'.

The lower bit discard circuit 23 discards the lower 3 bits' worth of the respective dither added pixel data LF, thereby obtaining the remaining upper 3 bits' worth of data as the multiple grayscale pixel data MD. That is, the following multiple grayscale pixel data MD are obtained, as shown in FIG. 13, for the eight adjacent display lines:

(8N−7)th display line: value MD '001';
(8N−6)th display line: value MD '010';
(8N−5)th display line: value MD '010';
(8N−4)th display line: value MD '001';
(8N−3)th display line: value MD '001';
(8N−2)th display line: value MD '010';
(8N−1)th display line: value MD '010'; and
(8N)th display line: value MD '001'.

These multiple grayscale pixel data MD are converted into 5-bit pixel drive data GD, as shown below, by the drive data conversion circuit 3:

(8N−7)th display line: drive data GD '0100';
(8N−6)th display line: drive data GD '0010';
(8N−5)th display line: drive data GD '0010';
(8N−4)th display line: drive data GD '0100';
(8N−3)th display line: drive data GD '0100';
(8N−2)th display line: drive data GD '0010';
(8N−1)th display line: drive data GD '0010'; and
(8N)th display line: drive data GD '0100'.

With the light emission drive patterns shown in FIG. 8, the discharge cells belonging to each of these eight adjacent display lines are driven to emit light at the following luminance levels:

discharge cells arranged on the (8N−7)th display line: luminance level '8';

discharge cells arranged on the (8N−6)th display line: luminance level '13';

discharge cells arranged on the (8N−5)th display line: luminance level '10';

discharge cells arranged on the (8N−4)th display line: luminance level '7';

discharge cells arranged on the (8N−3)th display line: luminance level '4';

discharge cells arranged on the (8N−2)th display line: luminance level '9';

discharge cells arranged on the (8N−1)th display line: luminance level '14'; and discharge cells arranged on the (8N)th display line: luminance level '3'.

As a result, the average of the luminance levels of the eight display lines is observed.

Figure 14:
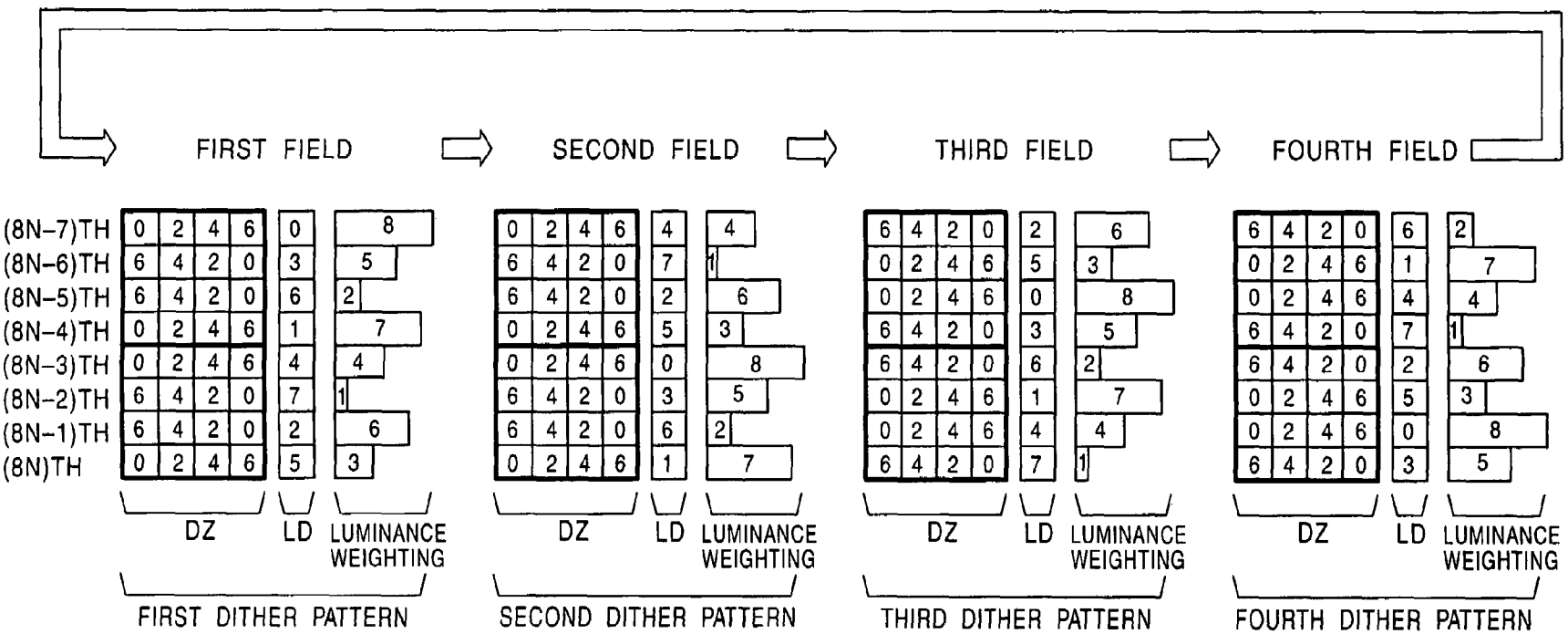
FIG. 14 illustrates transitions of the dither pattern.

The plasma display device shown in FIG. 3 prepares (creates) an image display through the combined usage of pixel dither processing, which adds pixel dither values DZ to pixel data of the pixels, and line dither processing, which drives eight adjacent display lines to each emit light at different luminance levels. As a result of the dither processing, discharge cells in eight rows and eight columns can be regarded as a pixel block, and a luminance that corresponds to the average luminance level of the discharge cells in the pixel block is observed for each of the pixel blocks. In this dither processing, based on the first to fourth dither patterns shown in FIG. 14 in which first to eighth different weighting values are allocated to eight adjacent display lines, discharge cells on the respective display lines are driven to emit light at different luminance levels. In the first to fourth dither patterns, the first to eighth weighting values are differently allocated to the eight adjacent display lines. As shown in FIG. 14, the drive control circuit 6 drives discharge cells arranged on respective display lines at different luminance levels based on the first dither pattern in the first field of the video input signal, the second dither pattern in the second field, the third dither pattern in the third field, and the fourth dither pattern in the fourth field. Further, the drive control circuit 6 repeatedly executes a serial drive operation between four fields based on these first to fourth dither patterns.

That is, a series of dither processing is repeated cyclically based on the four dither patterns, the number of which is less than the number of display lines, eight, to which different weightings have been allocated, in the pixel block of 8×8 discharge cells.

Therefore, the luminance levels of respective discharge cells arranged on each of the eight adjacent display lines in the pixel block move in each field, there being four fields in one cycle. Accordingly, the present invention makes it possible to create a favorable dither display in which the observed integration effect is improved and dither patterns are not readily observed, in comparison with a case where dither processing having eight fields as one cycle is executed on the basis of eight dither patterns (the number of dither patterns is equal to the number of display lines, i.e., eight).

In short, when dither processing based on dither patterns in which different weightings are allocated to N adjacent display lines is executed, a favorable dither display with a high observed integration effect is implemented by sequentially selecting, and using as a dither pattern, one of M dither patterns (first to Mth dither patterns). M is smaller than N.

This application is based on a Japanese patent application No. 2003-190405 filed on Jul. 2, 2003, and the entire disclosure thereof is incorporated herein by reference.

What is claimed is:

1. A driver device for driving a display panel, in which a plurality of pixel cells corresponding with pixels on display lines are arranged, in accordance with pixel data corresponding with the pixels based on a video input signal, the display lines being divided into a plurality of display line groups, each said display line group including N adjacent display lines, N being an integer greater than one, the driver device comprising:

a light emission driver for driving the pixel cells on the display lines in each said display line group to emit light in accordance with the pixel data, at respectively different luminance levels based on a selected dither pattern, the dither pattern including N weighting values allocated to the respective display lines of the display line group; and a dither pattern generating circuit for selecting, sequentially and in predetermined periods, the selected dither pattern among M different dither patterns consisting of first to Mth dither patterns, M being an integer less than N, wherein the dither pattern generating circuit repeatedly selects each of the first to Mth dither patterns.

2. The driver device according to claim 1, wherein the predetermined period is a single field display period of the video input signal.

* * * * *